US009065181B2

(12) United States Patent
De Rosny et al.

(10) Patent No.: US 9,065,181 B2
(45) **Date of Patent: *Jun. 23, 2015**

(54) DEVICE FOR RECEIVING AND/OR EMITTING AN ELECTROMAGNETIC WAVE, SYSTEM COMPRISING SAID DEVICE, AND USE OF SUCH DEVICE

(75) Inventors: Julien De Rosny, Nogent sur Marne (FR); Geoffroy Lerosey, Paris (FR); Arnaud Tourin, Sevres (FR); Mathias Fink, Meudon (FR); Fabrice Lemoult, Paris (FR)

(73) Assignees: Time Reversal Communications, Cergy Pontoise Cedex (FR); Centre National de la Recherche Scientifique-CNRS, Paris (FR)

( * ) Notice: Subject to any disclaimer, the term of this patent is extended or adjusted under 35 U.S.C. 154(b) by 127 days.

This patent is subject to a terminal disclaimer.

(21) Appl. No.: 13/505,946

(22) PCT Filed: Nov. 9, 2010

(86) PCT No.: PCT/EP2010/067143

§ 371 (c)(1), (2), (4) Date: May 3, 2012

(87) PCT Pub. No.: WO2011/054972

PCT Pub. Date: May 12, 2011

(65) Prior Publication Data

US 2012/0212388 A1 Aug. 23, 2012

(30) Foreign Application Priority Data

Nov. 9, 2009 (WO) ..... PCT/IB2009/056039

(51) Int. Cl.
*H01Q 1/50* (2006.01)
*H01Q 21/00* (2006.01)

(Continued)

(52) U.S. Cl.
CPC ..... *H01Q 15/006* (2013.01); *H01Q 15/0086* (2013.01); *H01Q 15/00* (2013.01); *H01Q 3/44* (2013.01); *H01Q 3/446* (2013.01); *H01Q 15/10* (2013.01); *H01Q 25/00* (2013.01)

(58) Field of Classification Search
CPC ..... H01Q 15/10; H01Q 25/00; H01Q 15/006; H01Q 3/44; H01Q 15/0086; H01Q 3/446
See application file for complete search history.

(56) References Cited

U.S. PATENT DOCUMENTS 6,791,432 B2 * 9/2004 Smith et al. ..... 333/99 S
7,352,941 B2 * 4/2008 Bratkovski et al. ..... 385/129

(Continued)

FOREIGN PATENT DOCUMENTS

WO WO 01/71774 9/2001
WO WO 2008/007024 1/2008
WO WO 2010/065555 6/2010

OTHER PUBLICATIONS

International Search Report dated May 18, 2010 for Application No. PCT/IB2009/056039.

(Continued)

*Primary Examiner* — Trinh Dinh
(74) *Attorney, Agent, or Firm* — Frost Brown Todd LLC

(57) ABSTRACT

A device for receiving and/or emitting an electromagnetic wave having a free space wavelength $\lambda_0$ comprised between 1 mm and 10 cm, comprising a medium (11) of solid dielectric material and the free space wavelength $\lambda_0$ corresponding to a wavelength $\lambda$ inside the medium, a plurality of conductor elements (12) incorporated inside the medium and spaced apart from each other of a distance lower than $\lambda/10$, and one antenna element (13). The conductor elements form small loop elements. A tuned conductor element among the conductor elements has a first end at a distance from the antenna element which is lower than $\lambda/10$, and has an electric resonance frequency corresponding to the wavelength $\lambda$.

12 Claims, 6 Drawing Sheets

(51) Int. Cl.

| | |
|---|---|
| ***H01Q 15/00*** | (2006.01) |
| ***H01Q 3/44*** | (2006.01) |
| ***H01Q 15/10*** | (2006.01) |
| ***H01Q 25/00*** | (2006.01) |

(56) References Cited

U.S. PATENT DOCUMENTS

| | | | | |
|---|---|---|---|---|
| 7,636,070 | B2 * | 12/2009 | De Lustrac et al. | 343/909 |
| 7,889,127 | B2 * | 2/2011 | Sajuyigbe et al. | 342/372 |
| 8,102,328 | B2 * | 1/2012 | Fink et al. | 343/837 |
| 8,207,907 | B2 * | 6/2012 | Hyde et al. | 343/909 |
| 8,456,620 | B2 * | 6/2013 | Kruglick | 356/51 |
| 2006/0114170 | A1 * | 6/2006 | Sievenpiper | 343/909 |
| 2009/0273538 | A1 * | 11/2009 | Smith et al. | 343/909 |
| 2009/0309805 | A1 * | 12/2009 | Fink et al. | 343/909 |
| 2010/0103049 | A1 * | 4/2010 | Tabakovic | 343/700 MS |
| 2011/0260946 | A1 * | 10/2011 | Dandekar et al. | 343/893 |
| 2012/0280886 | A1 * | 11/2012 | De Rosny et al. | 343/893 |
| 2013/0049903 | A1 * | 2/2013 | Liu et al. | 333/219 |

OTHER PUBLICATIONS

International Search Report dated Jan. 18, 2011 for Application No. PCT/EP2010/067143.

Erentok, A., et al. "Characterization of a Volumetric Metamaterial Realization of an Artificial Magnetic Conductor for Antenna Applications", IEEE Transactions on Antennas and Propagation, IEEE Service Center, Piscataway, NJ, US, Jan. 2005, vol. 53, No.1, pp. 160-172.

Fink, M., et al., "Time-reversed waves and super-resolution", Comptes Rendus, Physique, Elsevier, Paris, FR, vol. 10, No. 5, pp.447-463, Aug. 22, 2009.

Lemoult, F., et al., "Resonant Metalenses for Breaking the Diffraction Barrier", The American Physical Society, May 21, 2010, No. 104, pp. 203901-1-203901-4.

Mosallaei, H., et al. "Design and Modeling of Patch Antenna Printed on Magneto-Dielectric Embedded-Circuit Metasubstrate", IEEE Transactions on Antennas and Propagation, Jan. 2007, vol. 55, No. 1, pp. 45-52.

Shvets, G., et al., "Guiding, Focusing, and Sensing on the Subwavelength Scale using Metallic Wire Arrays", The American Physical Society, Aug. 3, 2007, No. 99, pp. 053903-1-053903-4.

* cited by examiner

FIG. 8
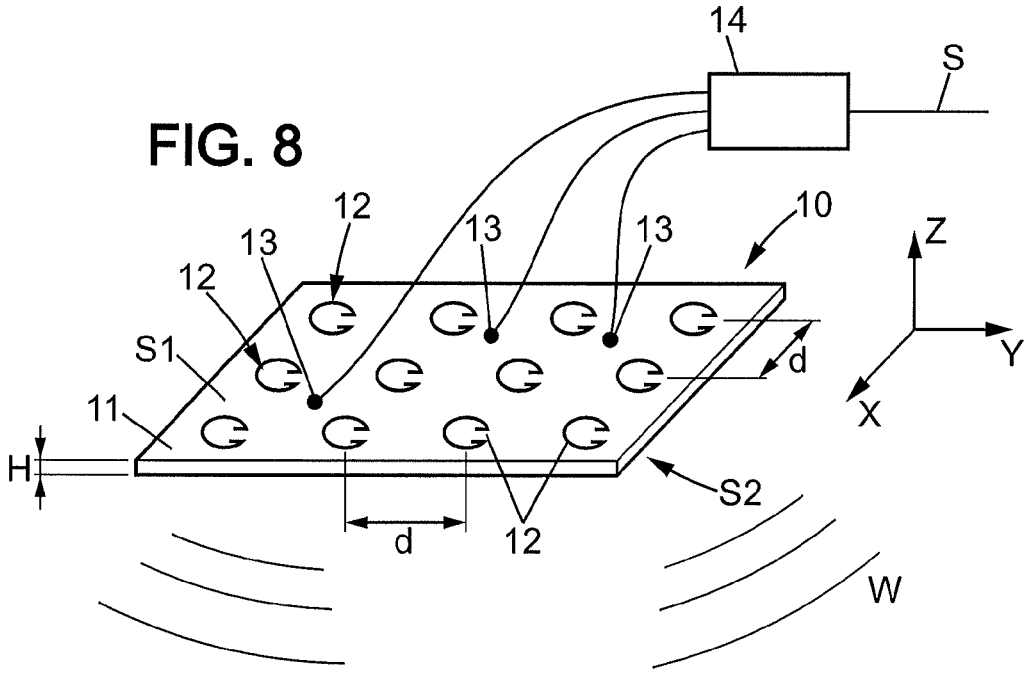
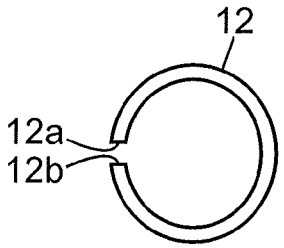
FIG. 9a
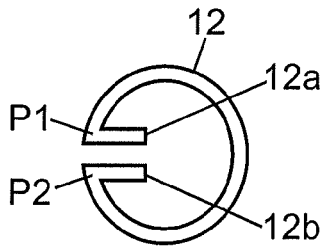
FIG. 9b
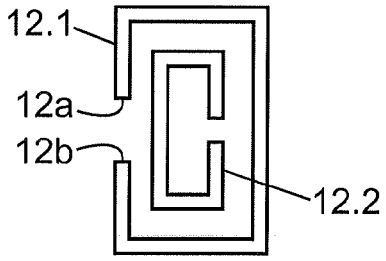
FIG. 9c
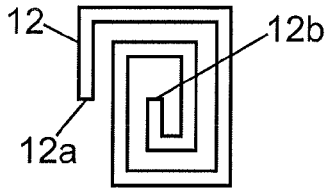
FIG. 9d

DEVICE FOR RECEIVING AND/OR EMITTING AN ELECTROMAGNETIC WAVE, SYSTEM COMPRISING SAID DEVICE, AND USE OF SUCH DEVICE

This application is a 371 of PCT/EP2010/067143 filed Nov. 9, 2010 which claims priority, under 35 USC §119, from PCT Application No. PCT/IB2009/056039 filed Nov. 9, 2009 both of which are incorporated herein by reference.

FIELD OF THE INVENTION

The present invention concerns a device for receiving and/or emitting an electromagnetic wave, a system comprising said device, and a use of such device.

BACKGROUND

It is known from the applicant's own patent application WO 2008/007024, a device having a reactive type antenna element surrounded by a plurality of metallic diffusers. Thanks to this arrangement, the electromagnetic wave is focused to a point i near the antenna element at a sub wavelength distance.

This device is efficient, but still need to be improved.

SUMMARY

One object of the present invention is to provide an improved device for receiving and/or emitting an electromagnetic wave.

To this effect, the device proposes a device for receiving and/or emitting an electromagnetic wave having a free space wavelength $\lambda_0$ comprised between 1 mm and 1 m, comprising:

a medium of solid dielectric material having at least a substantially plane first surface, the free space wavelength $\lambda_0$ corresponding to a wavelength $\lambda$ inside said medium (11), a plurality of conductor elements incorporated inside said medium, each conductor element being a wire of a predetermined length extending along said first surface, between a first end and a second end, and two neighbour conductor elements being spaced apart from each other of a distance lower than $\lambda/10$, wherein the conductor elements form an electric loop having an electric capacitor and an electric inductance, an antenna element intended to be connected to an electronic device for receiving or emitting an electric signal, another antenna element intended to be connected to said electronic device for receiving or emitting another electric signal, the other antenna element being different than the antenna element, and the other electric signal being different than the electric signal, Wherein at least one tuned conductor element among the conductor elements has its first end at a distance from said antenna element and said other antenna element which is lower than $\lambda/10$, said tuned conductor element has an electric resonance frequency corresponding to said wavelength $\lambda$ inside the medium, and the antenna element and the other antenna element are each one of the conductor element of the plurality.

Thanks to these features, the device comprises a tuned conductor element having an electromagnetic resonance in coincidence to an electromagnetic mode (EM) of the medium incorporating said conductor element. The device is therefore able to receive or emit efficiently an electromagnetic wave, and such device is extremely compact in size in a direction Z, and notably extremely flat. This device may be produced in a single electronic board. It is very inexpensive.

In various embodiments of the device, one and/or other of the following features may optionally be incorporated: the device has a plurality of electromagnetic modes inside said medium which have electric and magnetic vectors extending along said first surface, and which have a propagation vector extending along a direction perpendicular to the first surface, wherein said plurality of electromagnetic modes have a medium resonance frequency corresponding to said wavelength $\lambda$, the antenna element is positioned proximal to at least one antinode of the electromagnetic modes of said medium, and the other antenna element is positioned proximal to at least another antinode of the electromagnetic modes of said medium, the antinode and other antinode belonging to different modes of the electromagnetic modes;

the conductor elements, antenna element, and other antenna element are conductors printed above the first surface of an electronic board;

the device further comprises another tuned conductor element among the conductor elements, said other tuned conductor element being different than the tuned conductor element, and wherein said other tuned conductor element has its first end at a distance from said antenna element which is lower than $\lambda/10$, and said other tuned conductor element has another electric resonance frequency corresponding to another wavelength $\lambda^*$, the other wavelength $\lambda^*$ being different than the wavelength $\lambda$;

the device further comprises another tuned conductor element among the conductor elements, said other tuned conductor element being different than the tuned conductor element, and wherein the other tuned conductor element has its first end at a distance from said antenna element which is lower than $\lambda/10$, and the other tuned conductor element comprises a dielectric layer covering said other tuned conductor element adapted to generate an electromagnetic resonance along said other tuned conductor element corresponding to another wavelength $\lambda^*$, the other wavelength $\lambda^*$ being different than the wavelength $\lambda$;

the medium comprises holes modifying the refractive index of the medium;

the first ends of the conductor elements are regularly spaced inside said first surface, forming a periodic pattern above said first surface;

each first end of the conductor element is connected to an electric charge chosen in the list of an electric mass, a constant electric potential, a passive impedance, a resistance impedance, a capacitor impedance, and an inductor impedance;

the second end is distant from the first end of an ends distance lower than $\lambda/10$.

Another object of the present invention is to provide a system comprising a device for receiving and/or emitting an electromagnetic wave, wherein the antenna element is connected to an electronic device for receiving and/or emitting an electric signal, and the other antenna element is connected to the electronic device for receiving and/or emitting another electric signal.

Optionally, the antenna elements are connected to the electronic device via a coupling circuit, the coupling circuit preferably having a reactive impedance.

Another object of the present invention is to use a device for receiving and/or emitting an electromagnetic wave having a free space wavelength $\lambda$ comprised between 1 mm and 1 m, and preferably between 10 cm and 40 cm.

BRIEF DESCRIPTION OF THE DRAWINGS

Other features and advantages of the invention will be apparent from the following detailed description of seven of its embodiments given by way of non-limiting example, with reference to the accompanying drawings.

In the drawings:

FIG. 8 is an embodiment of the invention comprising loop conductor elements, FIGS. 9*a* to 9*d* are views of variants of the conductor elements of the device of FIG. 8.

MORE DETAILED DESCRIPTION

In the various figures, the same reference numbers indicate identical or similar elements. The direction Z is a vertical direction. A direction X or Y is an horizontal direction.

Figure 1:
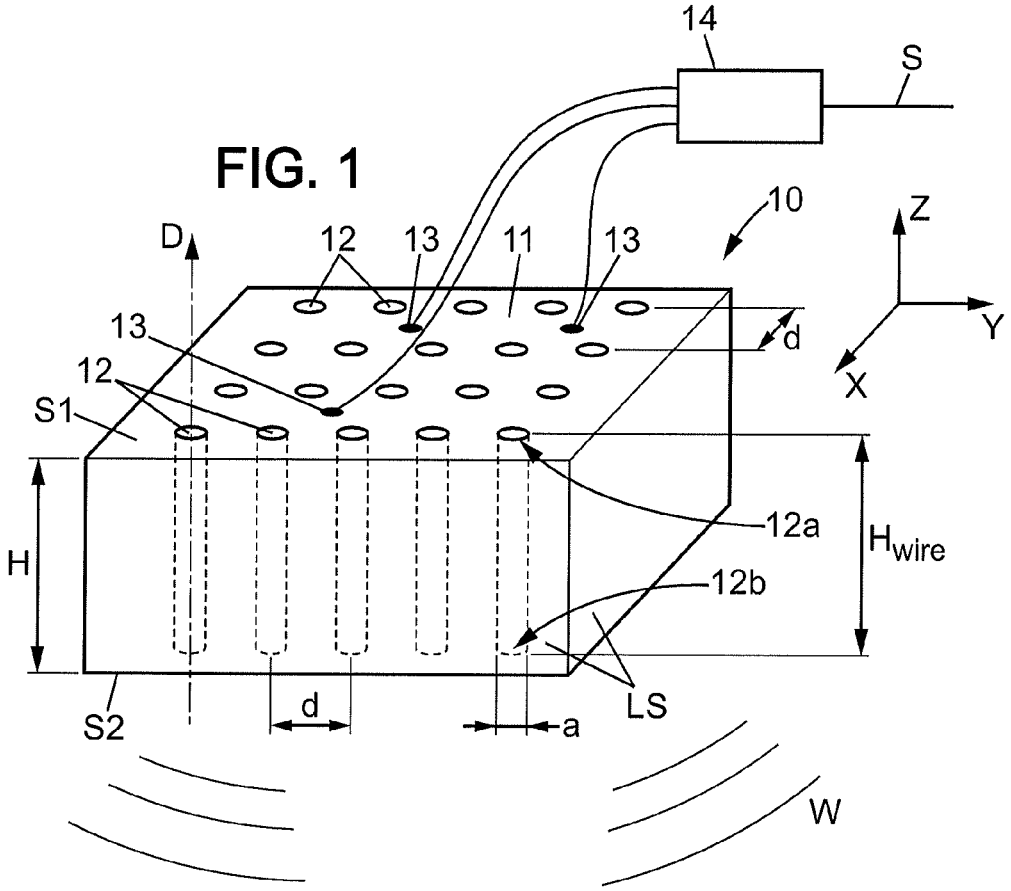
FIG. 1 is perspective view of a device for receiving or emitting an electromagnetic wave.

The FIG. 1 represents an example of a device 10 for receiving or emitting an electromagnetic wave W in a space and having a free space wavelength $\lambda_0$ comprised between 1 mm and 1 m, and preferably between 10 cm and 40 cm.

This device comprises:

a medium 11 of solid dielectric material, a plurality of conductor elements 12, that are wires incorporated inside said medium 11, and an antenna element 13 intended to be connected to an electronic device 14 for receiving or emitting an electric signal S representative of said electromagnetic wave W.

The medium has a refractive index $n_d$.

The space may be air and is considered to have a refractive index equal to one.

The free space wavelength $\lambda_0$ corresponds to a wavelength $\lambda$ inside the medium 11 with the following relation: $n_d \cdot \lambda = \lambda_0$.

The medium 11 has a parallelepiped shape, comprising a first surface S1 and a second surface S2, opposite to said first surface along the vertical direction Z. The first and second surfaces S1, S2 are substantially parallel planes. A direction D is substantially a straight line perpendicular to said surfaces and parallel to the vertical direction Z. The first and second surfaces S1, S2 are distant of a height value H.

The medium has an electric permeability of $\in_d$.

The conductor elements 12 are circular wires of diameter and extending along said direction D. These conductor elements 12 have a first end 12*a* on said first surface S1 and a second end 12*b* on said second surface S2. Each conductor element 12 has a length of the same value H. In this first embodiment the conductor elements 12 form on the first surface S1 or any plane XY perpendicular to said vertical direction Z a regularly spaced square grid. The conductor elements 12 are parallel to each other along the vertical direction Z and are spaced from each other along the direction X or Y of a distance d lower than $\lambda/10$. This sub-wavelength distance d is the step of said grid. The conductor elements 12 form therefore a regular lattice of wires.

One or several antenna elements 13 are installed on said first surface S1 or said second surface S2 or both of them. The antenna elements 13 may be fed with a single electric signal S to emit or receive a single electromagnetic wave W, or they may be fed with a plurality of electric signals to emit or receive simultaneously a plurality of electromagnetic waves.

In such wire medium comprising wire conductor elements 12 embedded inside a medium 11, the magnetic field vector B and the electric field vector E are perpendicular to said direction D, and the propagation wave vector K is a propagation vector collinear to said direction D. The electromagnetic wave W is a plane wave propagating inside the medium 11 along the direction D.

Figure 2A:
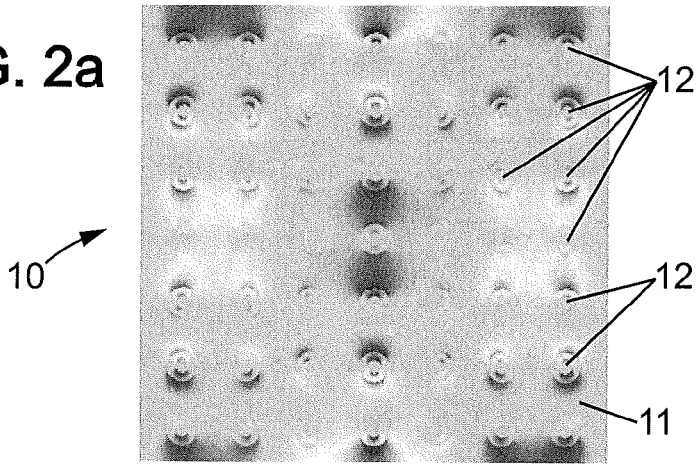
FIGS. 2*a*, 2*b* and 2*c* are three views of three transverse electromagnetic modes inside the device of FIG. 1.
Figure 2B:
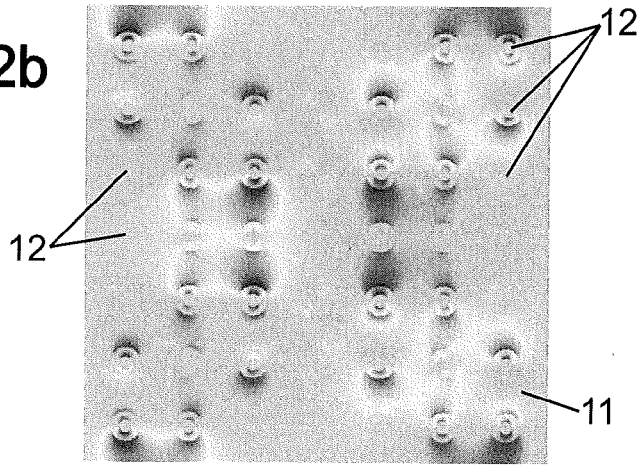
Figure 2C:
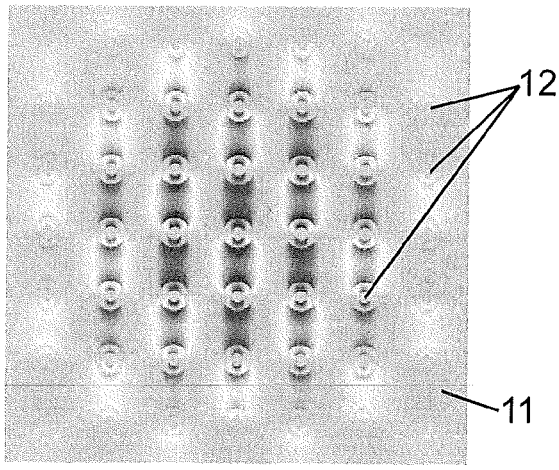

The magnetic field vector B and electric field vector E have transverse electromagnetic modes TEM inside said medium 11, with nodes and antinodes. These TEM modes have sub-wavelengths variations along directions X and Y. FIGS. 2*a*, 2*b* and 2*c* represent the amplitude variations of the electric field vector E inside the medium 11 according three different modes, wherein the medium 11 incorporates 7×7 conductor elements 12. Each mode has a different pattern inside the medium 11 and is orthogonal to the other modes. Thanks to this physical property of diversity, the electric signals of a plurality of antenna elements 13 at the boundary of the medium 11 are uncorrelated to each other. These antenna elements 13 may be used independently from each other or may be used in a multi-input multi-output (MIMO) configuration. Moreover, this plurality or array of antenna is an extremely compact device in size.

The wire medium is a non dispersive medium and the dispersion relation is:

$$\omega = k_z \cdot c / n_d,$$

where:

$k_z$ is the Z component value of the propagation wave vector K, c is the electromagnetic wave speed in vacuum, $n_d$ is the refractive index of the medium material.

For example, the refractive index of air is 1 and the refractive index of epoxy is around 2.

The medium 11 is therefore an anisotropic medium. Each TEM mode has the same propagation speed and the same resonance frequency f, $f = \omega/(2 \cdot \pi)$.

All or part of the conductor elements 12 of the medium 11 can be tuned to this resonance frequency f. The conductor elements 12 may have a specific length $H_{wire}$ between $0.7 \cdot N \cdot \lambda/2$ and $N \cdot \lambda/2$, where:

N is a natural integer, and $\lambda$ is the wavelength inside the medium.

More precisely, the conductor elements 12 may have a specific length $H_{wire}$ of:

$$H_{wire} = N \cdot \lambda/2.$$

The tuned conductor elements 12 have therefore a resonance frequency in coincidence with the resonance frequency of the TEM modes.

Thanks to this tuning, the TEM modes may excite or may be excited by most of the conductor elements 12 incorporated inside the medium 11.

Advantageously, the antenna element 13 may be positioned proximal to at least one antinode of the transverse electromagnetic modes of the medium 11. This may improve the device sensitivity to receive and/or emit the electromagnetic wave.

A plurality of antenna elements 13 may be implemented inside the device. Each antenna element 13 of this plurality may be positioned proximal to a different antinode of the transverse electromagnetic modes TEM. Each antenna element 13 is then fed with a single electric signal S. Then, a plurality of modes belonging to the TEM modes are excited and more conductor elements 12 contribute to receive and/or emit the electromagnetic wave W. By this way, the radiation diagram of the device may be affected.

A plurality of antenna elements 13 may be implemented inside the device. Each antenna element 13 of this plurality may be positioned proximal to a different antinode of the transverse electromagnetic modes TEM. Each antenna element 13 may be fed with a different electric signal S. By this way, the device can receive and/or emit a different and independent electromagnetic waves W, simultaneously.

In a first variant, the antenna element 13 may be simply one of the conductor elements 12 of the wire media that is connected to the electronic device 14.

In a second variant, the antenna element 13 is a conductor patch or wire above an electronic board, said electronic board being in close proximity with the first surface S1 and/or second surface of the medium 11.

In various embodiments, it is possible to generate inside said medium TEM modes with different resonant frequencies.

Figure 3:
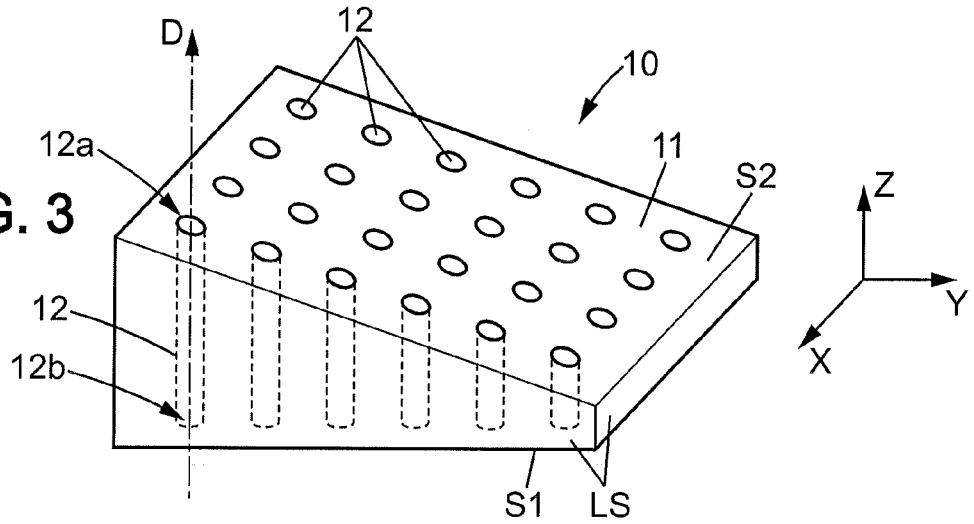
FIG. 3 is an example comprising a medium having a bevel shape.

In an example shown on FIG. 3, the wire medium described above is cut along a plane not parallel to said first surface S1, to form a bevel shape. The conductor elements 12 incorporated in such medium have a plurality of lengths between $H_{wire,min}$ to $H_{wire,max}$, $H_{wire,min}$ corresponding to the height of the lowest portion of the medium and $H_{wire,max}$ corresponding to the height of the highest portion of the medium. The device is then adapted to a predetermined range of wavelengths corresponding to this range of heights.

Figure 4:
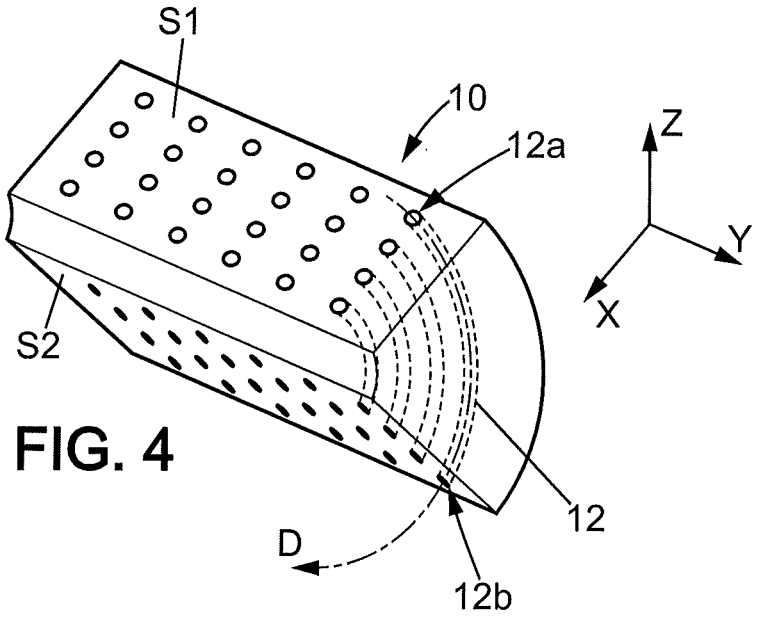
FIG. 4 is an example comprising a medium having an arched shape.

In an example shown on FIG. 4, the direction D is an arched direction between said first surface S1 and said second surface S2. For example, the medium is made of flexible sheets having conductor stripes on each of them, these sheets being arched and stacked together. The conductor stripes (conductor elements) 12 near the centre of arc or with a short radius are shorter than the conductor stripes with a longer radius.

Figure 5:
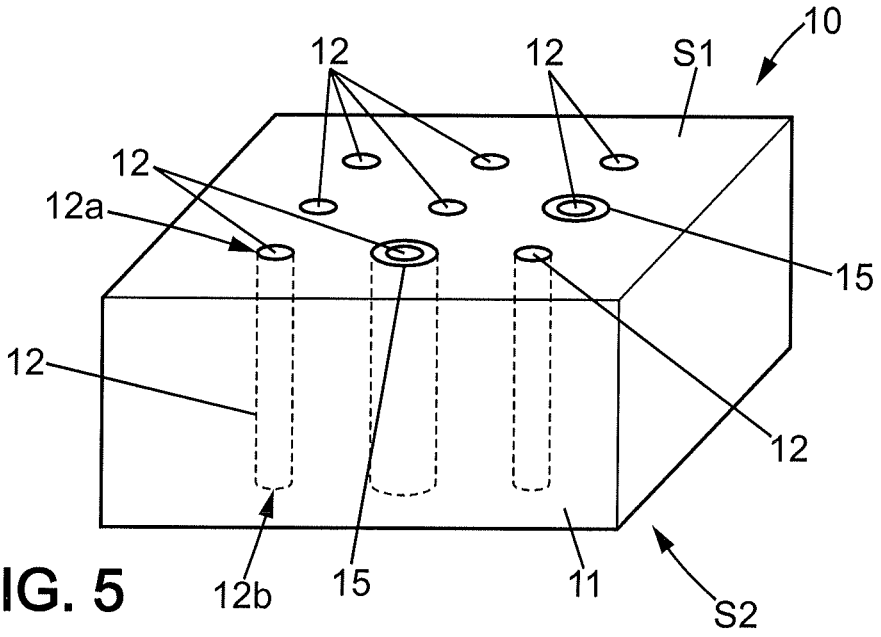
FIG. 5 is an example comprising a dielectric layer surrounding some conductor elements of the device.
Figure 6:
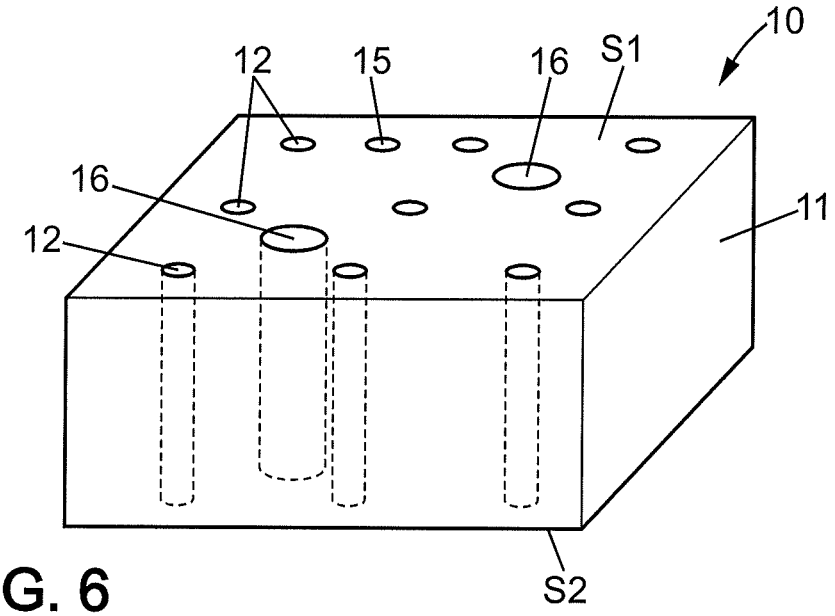
FIG. 6 is an example comprising holes inside the medium of the device.

In an example shown on FIG. 5, some of the conductor elements 12 have a dielectric layer 15 cowering said conductor elements. The dielectric layer 15 has an electric permeability of $\in_{layer}$ different than the electric permeability $\in_d$ of the medium 11. The resonant frequency of the conductor elements 12 covered with said dielectric layer 15 is different than the resonant frequency of the conductor elements 12 without said layer 15.

In an example shown on FIG. 3, the medium 11 is bored to form holes 16. The holes are modifying the refractive index $n_d$ of the medium 11 near predetermined conductor elements 12.

Figure 7:
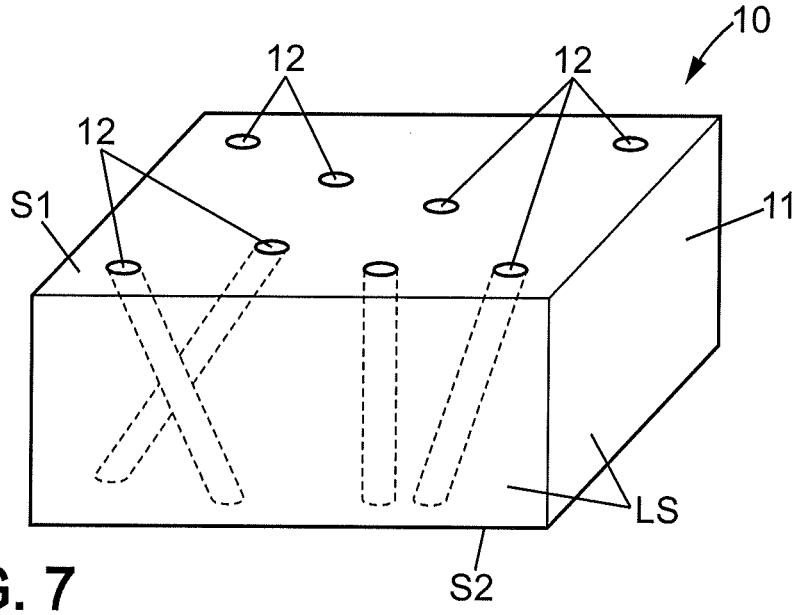
FIG. 7 is an example having non parallel conductor elements.

In an example shown on FIG. 7, the conductor elements 12 are not parallel to each other. The lengths of the conductor elements 12 vary inside the medium Moreover, contrary to the previous examples, the conductor elements 12 do not form a periodic pattern along the first surface S1.

Thanks to the five previous various examples, the medium 11 comprises several resonant frequencies and the device for receiving or emitting an electromagnetic wave may have an enlarged bandwidth.

Additionally and according more variants:

lateral surfaces LS of the medium may be covered with a conductive material, the first surface may have a ground plane, the conductor elements 12 may form loop shapes, or curvilinear shapes, the antenna elements 13 may be a monopole, or a dipole, the antenna elements 13 may be wires shorter than the wavelength or longer than the wavelength, the antenna elements 13 may be incorporated inside the medium 11, or along the first surface S1 or along the first and second surfaces S1, S2.

The present invention device 10 may be manufactured by known methods. For example, multilayer copper etching above epoxy material may be used, each layer comprising a plurality of conductor elements inside the plane of the layer.

In embodiment of the invention shown on FIG. 8, medium 11 has a plate shape, having a first surface S1 and a second surface S2 distant of a height value H. Said height is lower than in the previous embodiments, and the device 10 is more compact in the vertical direction Z.

The conductor elements 12 are wires extending upon the first surface S1. Each conductor element forms an electrical circuit forming a small loop, having at least one opening. For example, the conductor element 12 has a form like a letter C. The loop behaves like an electric inductance L and the opening behaves like an electric capacitor C, so that the conductor element 12 behaves like a small electric circuit having a resonance frequency $f_c$, such resonance frequency $f_c$ being substantially equal to $$\frac{1}{2\pi}\sqrt{LC}.$$

These conductor elements 12 may be called "split ring resonators" (SRR).

FIGS. 9*a* to 9*d* show four variants of a conductor element 12. It comprises a first point P1 and a second point P2 between a first end 12*a* and a second end 12*b*.

For example, the first and second points P1, P2 are distant from each other of a straight line distance lower than $\lambda/10$. The conductor element 12 has a capacitive effect of an electric capacitor C between these first and second points P1, P2. The conductor element 12 forms a small loop between these first and second points P1, P2, having an inductive effect of an electric inductance L.

The conductor element 12 behaves as an electric circuit having a resonance frequency $f_c$.

The conductor element 12 has a length of value $H_{wire}$ between the first and second ends 12*a*, 12*b*.

The conductor element 12 may comprise a plurality of loops and openings, behaving like a plurality of indictors and capacitors. Many arrangements of these inductors and capacitors exist, to have a plurality of resonance frequencies $f_c$.

A first and second antenna elements 13 (at least one and another) are at installed on the first surface S1. Each antenna element 13 is fed with a single electric signal S to emit or receive an electromagnetic wave W (modification of the radiation diagram), or with a plurality of different and independent electric signals to emit or receive simultaneously a plurality of electromagnetic waves (MIMO).

The first and second antenna elements 13 are preferably two of the conductor elements 12 connected directly or indirectly via a coupling circuit to an electronic device. The design of the device is therefore simple. It may be produced with only one layer of circuit board. The device is not expensive.

The coupling circuit preferably has reactive impedance.

Figure 10:
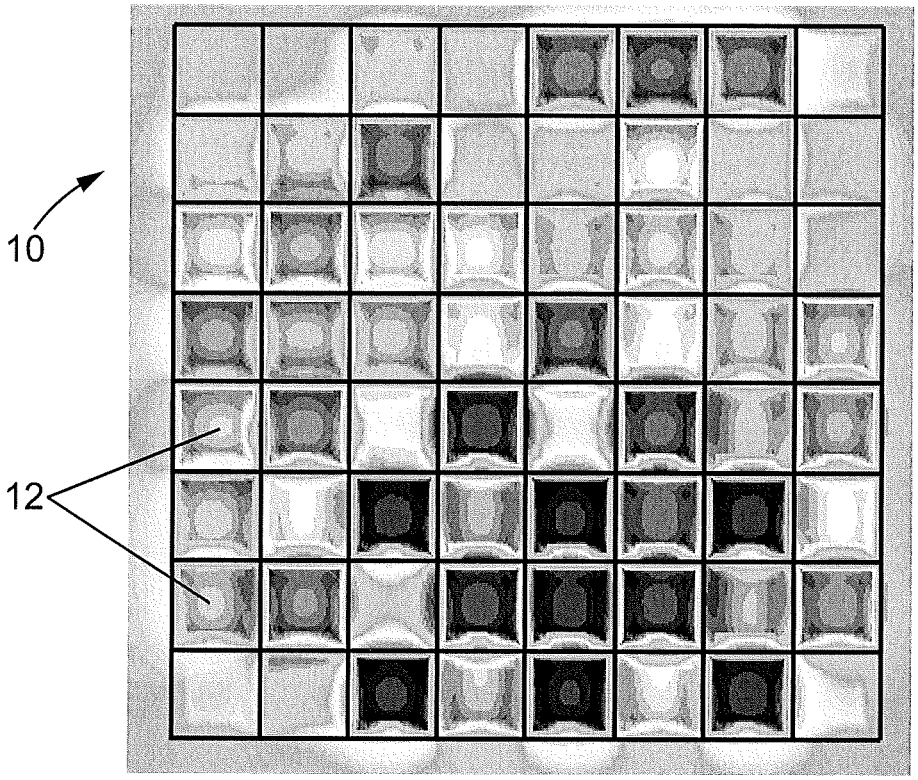
FIG. 10 is a view of an electromagnetic mode inside the device of FIG. 8.

The medium 11 may incorporates an array of conductor elements 12 as shown on FIG. 8. Such array is a metamaterial medium having in the XY plane of the first surface S1 a plurality of electromagnetic modes EM, with nodes and antinodes. These EM modes have sub-wavelengths variations along the directions X and Y, like the TEM modes of the six above described embodiments. FIG. 10 represent the amplitude variations of the electric field vector E inside the medium 11 according to one EM mode, wherein the medium 11 incorporates 8×8 conductor elements 12. Each mode has a different pattern inside the medium 11 and is orthogonal to the other modes. The electric signals of the first and second antenna elements 13 are therefore uncorrelated to each other. The antenna elements 13 may be used independently from each other in a MIMO configuration.

Such device is compact in size, mainly in the direction Z. Such device may be a single plate of circuit board. It is flat and inexpensive.

The tuned conductor elements 12 have a resonance frequency $f_c$ in coincidence with the resonance frequency of the electromagnetic modes EM of the medium 11.

Thanks to this feature, the electromagnetic modes EM may excite or may be excited by most of the conductor elements 12 incorporated inside the medium 11.

The first and second antenna elements 13 are positioned proximal to one antinode of the electromagnetic modes of the medium 11, to improve the device sensitivity to receive and/or emit the electromagnetic wave W.

The conductor elements 12 may be all identical.

The conductor elements 12 may not be all identical. There may be a distribution of a plurality of different conductor elements 12 (size, shape, etc. . . . ). The electromagnetic diversity in the metamaterial is increased and the electric signals of the first and second antenna elements 13 are more uncorrelated. The separation of the signals is improved.

The conductor elements 12 may be positioned as a regular array above the first surface S1.

Alternatively, the conductor elements 12 may not be regularly positioned on the first surface. The electromagnetic diversity in the metamaterial is also increased, and the signal are more uncorrelated at a sub-wavelength.

The invention claimed is:

1. A device for receiving and/or emitting an electromagnetic wave having a free space wavelength $\lambda_0$ between 1 mm and 1 m, comprising:

a medium of solid dielectric material having at least a substantially planar first surface, the free space wavelength $\lambda_0$ corresponding to a wavelength $\lambda$ inside said medium, a plurality of conductor elements incorporated inside said medium, each conductor element being a wire of a predetermined length extending upon said first surface between a first end and a second end, and two neighbour conductor elements being spaced apart from each other at a distance less than $\lambda/10$, wherein the conductor elements form an electric loop having an electric capacitor and an electric inductance, an antenna element intended to be connected to an electronic device for receiving or emitting an electric signal, an other antenna element intended to be connected to said electronic device for receiving or emitting another electric signal, the other antenna element being different than the antenna element, and the other electric signal being different than the electric signal, wherein at least one tuned conductor element among the conductor elements has its first end at a distance from said antenna element and from said other antenna element which is less than $\lambda/10$, said tuned conductor element has an electric resonance frequency corresponding to said wavelength $\lambda$ inside the medium, and the antenna element and the other antenna element are each one of the plurality of conductor elements.

2. The device according to claim 1, having a plurality of electromagnetic modes inside said medium which have electric and magnetic vectors extending along said first surface, and which have a propagation vector extending along a direction perpendicular to the first surface, wherein said plurality of electromagnetic modes have a medium resonance frequency corresponding to said wavelength $\lambda$.

3. The device according to claim 2, wherein said antenna element is positioned proximal to at least one antinode of the electromagnetic modes of said medium, and said other antenna element is positioned proximal to at least an other antinode of the electromagnetic modes of said medium, the antinode and other antinode belonging to different modes of the electromagnetic modes.

4. The device according to claim 1, wherein said conductor elements, antenna element, and other antenna element are conductors printed above the first surface of an electronic board.

5. The device according to claim 1, further comprising another tuned conductor element among the conductor elements, said other tuned conductor element being different than the tuned conductor element, and wherein said other tuned conductor element has its first end at a distance from said antenna element which is less than $\lambda/10$, and said other tuned conductor element has an other electric resonance frequency corresponding to another wavelength $\lambda^*$, the other wavelength $\lambda^*$ being different than the wavelength $\lambda$.

6. The device according to claim 1, further comprising an other tuned conductor element among the conductor elements, said other tuned conductor element being different than the tuned conductor element, and wherein the other tuned conductor element has its first end at a distance from said antenna element which is less than $\lambda/10$, and the other tuned conductor element comprises a dielectric layer covering said other tuned conductor element adapted to generate an electromagnetic resonance along said other tuned conductor element corresponding to another wavelength $\lambda^*$, the other wavelength $\lambda^*$ being different than the wavelength $\lambda$.

7. The device according to claim 1, wherein the medium comprises holes modifying the refractive index of the medium.

8. The device according to claim 1, wherein the first ends of the conductor elements are regularly spaced inside said first surface, forming a periodic pattern above said first surface.

9. The device according to claim 1, wherein each first end of the conductor element is connected to an electric charge selected from an electric mass, a constant electric potential, a passive impedance, a resistance impedance, a capacitor impedance, and an inductor impedance.

10. The device according to claim 1, wherein the second end is distant from the first end of an ends distance less than $\lambda/10$.

11. A system comprising a device for receiving and/or emitting an electromagnetic wave according to claim 1, wherein the antenna element is connected to an electronic device for receiving and/or emitting an electric signal, and the other antenna element is connected to the electronic device for receiving and/or emitting another electric signal.

12. The system according to claim 11, wherein the antenna elements are connected to the electronic device via a coupling circuit, said coupling circuit preferably having a reactive impedance.

* * * * *